United States Patent [19]

Redman

[11] 4,397,124

[45] Aug. 9, 1983

[54] GLASS JACKS FOR DOORS, WINDOWS, WALLS, ETC.

[75] Inventor: Ronald E. Redman, Niles, Mich.

[73] Assignee: Kawneer Company, Inc., Niles, Mich.

[21] Appl. No.: 272,113

[22] Filed: Jun. 10, 1981

[51] Int. Cl.[3] ..... E06B 3/00

[52] U.S. Cl. ..... 52/126.4; 52/824; 52/397; 52/217

[58] Field of Search ..... 52/208, 211, 212, 824, 52/455, 126.1, 126.4, 126.7, 126.6, 222, 291, 126.3, 397, 217; 411/402, 404, 378, 396, 383

[56] References Cited

U.S. PATENT DOCUMENTS

| | | | |
|---|---|---|---|
| 2,103,944 | 12/1937 | Gullborg | 411/402 |
| 2,610,369 | 9/1952 | Huizenga | 52/824 |
| 3,224,152 | 12/1956 | Evans | 52/211 |
| 3,404,501 | 10/1968 | Von Wedel | 52/126.4 |
| 3,413,761 | 12/1968 | Proni | 52/126.1 |
| 3,780,472 | 12/1973 | Biebuyck | 49/501 |

FOREIGN PATENT DOCUMENTS

| | | | |
|---|---|---|---|
| 976787 | 10/1975 | Canada | 411/402 |
| 1429299 | 3/1976 | United Kingdom | 411/402 |

*Primary Examiner*—Reinaldo P. Machado
*Assistant Examiner*—Alvin C. Chin-Shue
*Attorney, Agent, or Firm*—Mason, Kolehmainen, Rathburn & Wyss

[57] ABSTRACT

A glass jack for doors, windows, walls, etc. having a rectangular frame formed with interconnected stiles and rails providing one or more rectangular openings for receiving a panel, which is mounted in the opening with an outer peripheral edge closely facing adjacent wall surfaces of the surrounding frame members. One or more glass jacks is mounted to extend between the edge of the panel and an adjacent facing wall surface of the frame members at selected point(s) for maintaining an adjustably selected spacing interval between the edge of the panel and the frame member. The glass jack includes an elongated, shank threaded into an opening in the facing wall of the frame member and a radial head having an outer edge surface with ribs and grooves thereon to facilitate manual rotation when adjusting the jacks to control the spacing interval. An outer end surface of the head is positioned to engage the edge of the panel and the end surface is formed with a small deformable annular rib coaxially aligned with respect to the shank. When the jack is tightened the rib is forced against the edge of the glass panel and is deformed in segments provide a stop at engaging corners of opposite faces of the glass panel. The stops formed at the ends of the depressed rib segments resist inadvertent rotation of the glass jacks after a selecting spacing or clearance is attained and a flat portion of the head surface extending between the depressed rib segments bears directly against the edge of the glass.

33 Claims, 17 Drawing Figures

2
50
20
24
66
2
4
4
90
46
24
24
46
44
18
90
90
16
14
66
46
90
3
22
24
48
12
3

28
44
32
86
86
32
88
90
92
90
32
92
32
94
88
48
94
34
96
28
96
26
24
22
30

60
64
30
62
58
20
26
96
54
50
96
94
24
94
28
56
34
88
32
32
90
90
88
86
86
92
92
52
44

26
94
32
90
88
44
28
86
96
92
30
70
68
66
82
94
92
96
86
24
34
32
90
88

26
34
32
90A
92a
93
86
96
28
94
30
70
68
66
82
96
94
44
93
24

32
90A
86
92a

FIG. 6
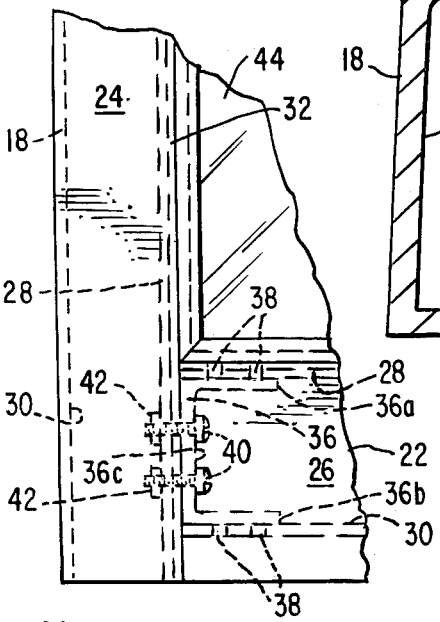
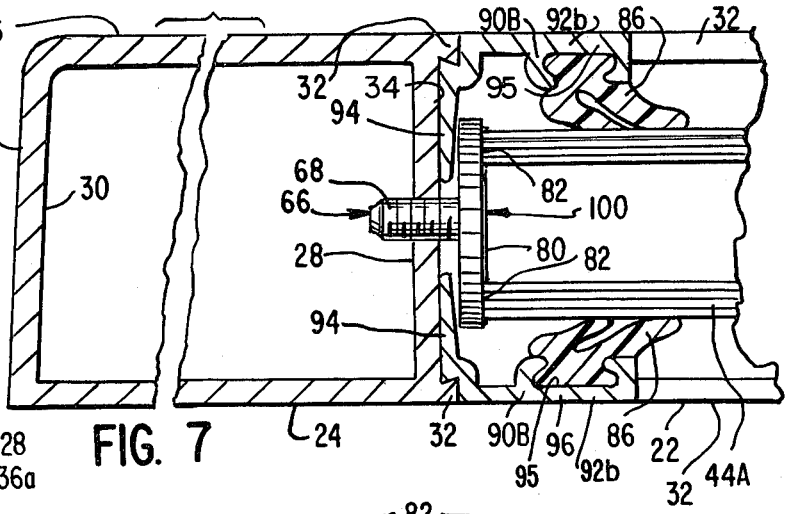
FIG. 7
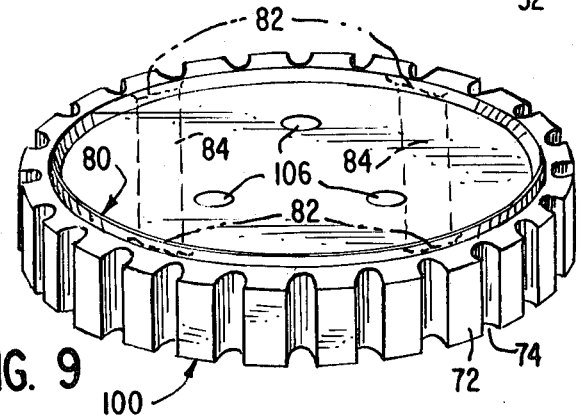
FIG. 9
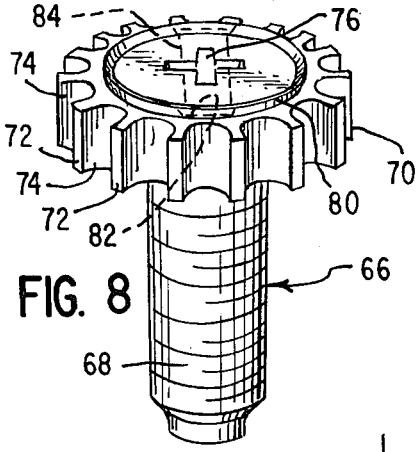
FIG. 8
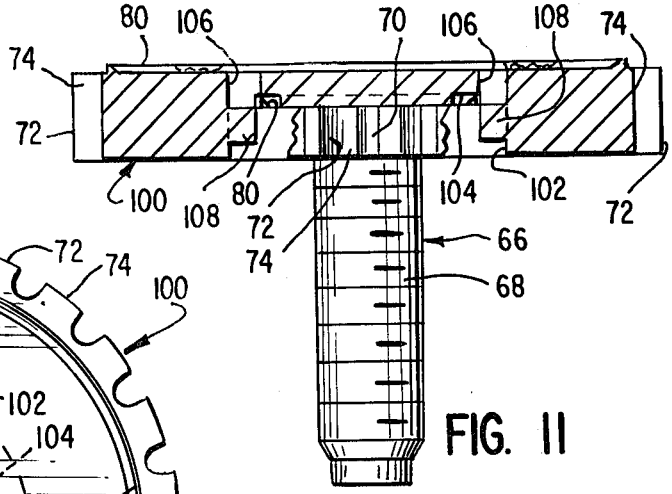
FIG. 11
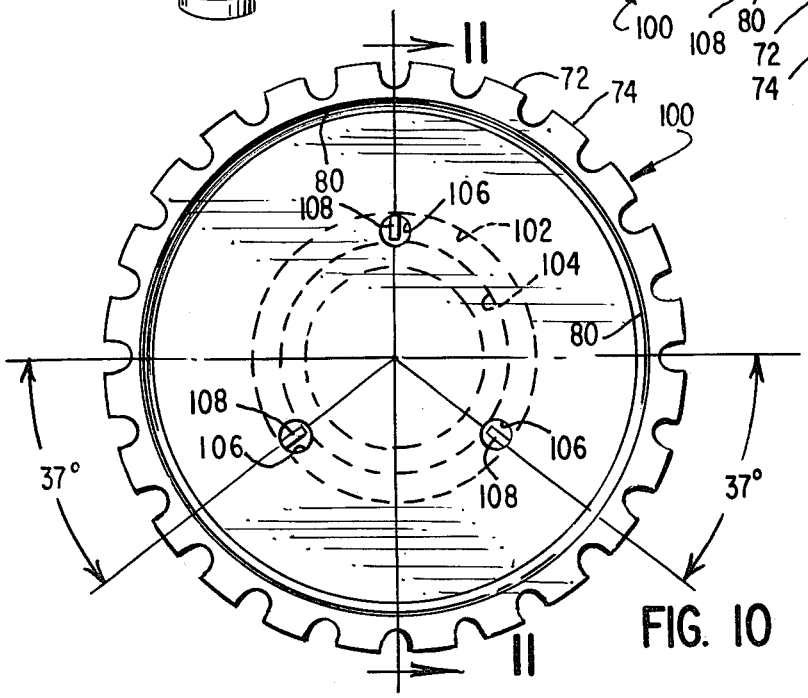
FIG. 10

FIG. 13
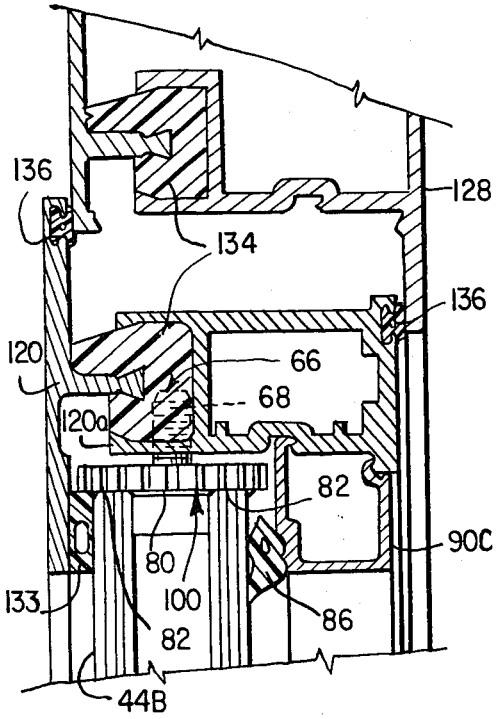
FIG. 12
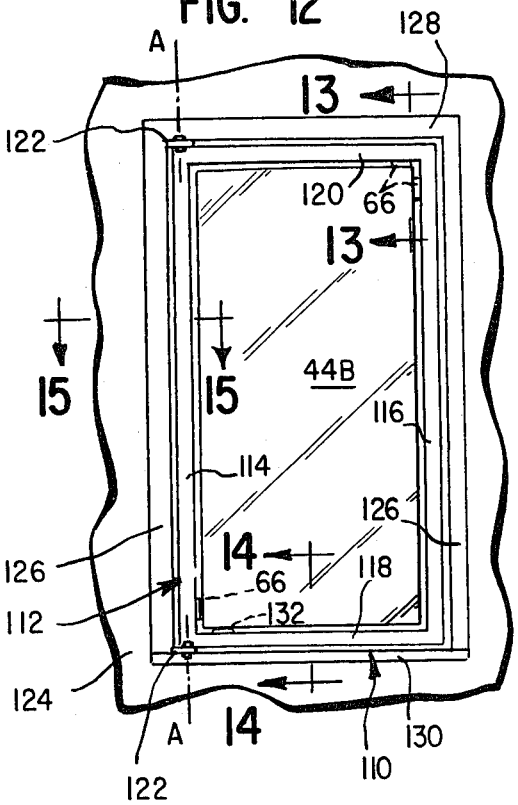
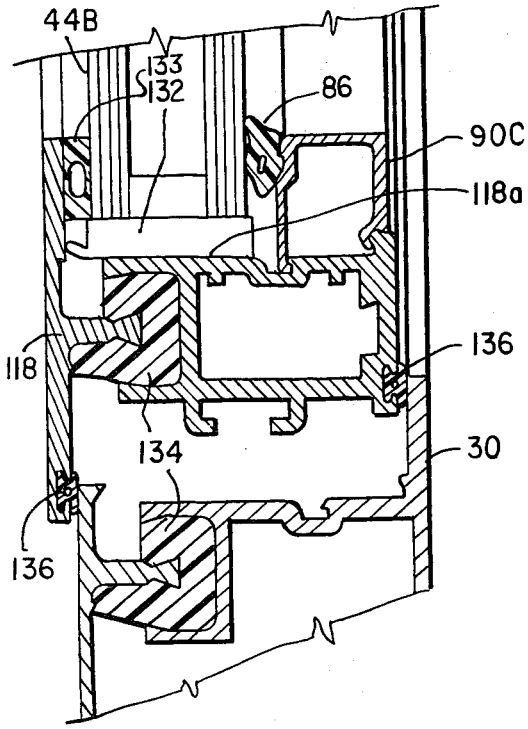
FIG. 14
FIG. 15
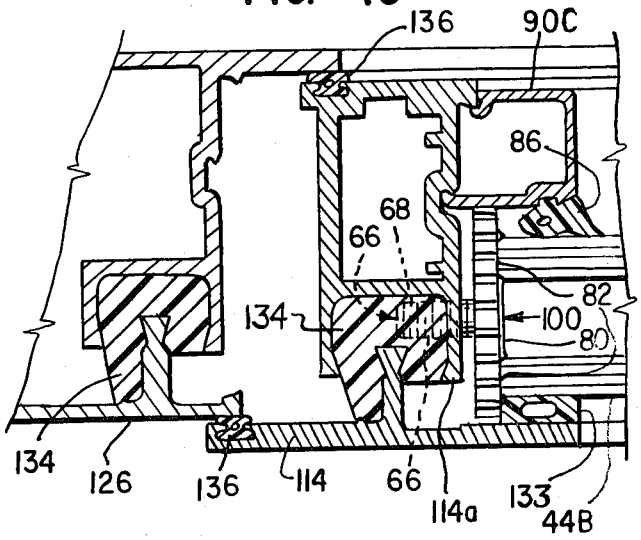

GLASS JACKS FOR DOORS, WINDOWS, WALLS, ETC.

BACKGROUND OF THE INVENTION

A. Field of the Invention

The present invention relates to a new and improved glass jack for use in adjusting and supporting the edges of panels in surrounding of doors, windows, curtain walls etc. and is particularly useful in a door construction of the type employing one or more large panels of glass or other panel material mounted in a surrounding rectangular frame opening. The novel glass jack is useful for selectively adjusting the spacing interval between the edges of a panel and surfaces of facing frame members in a manner which facilitates easy manual adjustment and provides for the tranmission of forces between the panel and the frame.

B. Description of the Prior Art

U.S. Pat. Nos. 2,610,369 and 3,780,472 disclose door constructions of a type wherein a rectangular metal frame is provided and a large door panel of glass or the like is supported therein. These types of doors are well suited for commercial and heavy traffic installations wherein a strong and lightweight metal door frame is specified with a large door panel of glass.

It is an object of the invention to provide a new and improved glass jack for use in doors, windows, walls, closures etc. having metal frame members and large panels of glass or other material.

It is an object of the present invention to provide a new and improved door construction of the character described.

Another object of the present invention is to provide a new and improved glass jack of the character described which is suitable for use with panels of different thickness.

Another object of the present invention is to provide a new and improved window construction uti,izing glass jacks of the character described.

Still another object of the present invention is to provide a new and improved wall construction utilizing glass jacks of the character described.

Another object of the present invention is to provide a new and improved door construction wherein glazing of the door is greatly simplified initially and before installation of the door in a building opening, as well as while reglazing while the door frame is in an installed position.

Yet another object of the present invention is to provide a new and improved door, window, wall, etc. construction of the character described having novel glass jacks which are manually operable to adjust and maintain the spacing or clearance between the edges of a glazing panel and the facing wall sections of the surrounding frame members.

Yet another object of the present invention is to provide a new and improved glass jack system of the character described which is capable of use with both single thickness type glass panels and dual thickness type glass panels having an insulating air space between the glass panes.

Yet another object of the present invention is to provide a new and improved glass jack of the character described which includes means for resisting inadvertent rotation and adjustment of the jack in position after a selected spacing is obtained.

Still another object of the present invention is to provide a new and improved door, window, wall, etc. construction wherein novel glass jacks of the type described are utilized effectively for the transmission of forces and stress between the surrounding frame members and the panel(s) mounted in the frame.

Still another object of the present invention is to provide a new and improved glass jack of the character described which may be utilized with existing glass stops and trim members of a type already installed on doors, windows, walls, etc. and the like and which does not interfere with the utility of these glass stops or the installation and reinstallation thereof during a glazing-/reglazing process.

Still another object of the present invention is to provide a new and improved door window, wall, etc. construction of the character described which reduces stresses which may be imparted into the glass panel and thus prolongs and improves the operating life even though heavy traffic and rough usage conditions or weathering may be encountered.

Yet another object of the present invention is to provide a new and improved glass jack of the character described which does not alter or impair the pleasing appearance of doors, windows, walls, etc. even those having relatively narrow stiles and/or rails with large glass panels carried thereby.

Another object of the invention is to provide a new and unique doors, windows, walls, etc. construction with is highly efficient in terms of cost and the amount of metal required yet one that is pleasing in appearance and capable of long life in a heavy duty commercial usage and tough weathering environment.

SUMMARY OF THE INVENTION

The foregoing and other objects and advantages of the present invention are accomplished in an illustrated embodiment comprising a novel glass jack for use in doors, windows, walls, etc. constructions having a rectangular metal frame with interconnected stiles and rails forming one or more rectangular openings for receiving a panel(s). A panel such as a sheet of single thickness or dual pane insulating glass panel is mounted in the frame opening with a peripheral edge in closely facing adjacent relation with wall surfaces of the metal frame members. A plurality of glass jacks are mounted between the edge of the panel and the adjacent wall surfaces of the frame members and the jacks are manually adjustable for maintaining selected spacing interval or clearance between the edge of the panel and the adjacent facing frame surface. Each jack includes an elongated threaded shank which is mounted in a threaded opening in the adjacent facing wall of the frame member. Manual rotation of the jack provides adjustment to increase or decrease the spacing between the panel edge and the frame member. The jack includes a radial head extending outwardly of the shank at one end and having a circular, flat end surface adapted to engage the edge of the glass panel. The head is formed with a peripheral edge having alternate ribs and grooves providing a knurled effect to facilitate manual rotation of the threaded jack shank for adjusting the spacing interval. A small, annular rib is formed on the circular end surface of the head and the rib is deformable in diametrically spaced apart depressed segments when engaged against the edge of the glass panel. The ends of the depressed segments on the rib form glass engaging corners or stops against opposite faces of the glass panel for resisting inadvertent further rotation of the glass jack after a jack is adjusted to provide a selected spacing interval or clearance with the surrounding frame.

BRIEF DESCRIPTION OF THE DRAWING

For a better understanding of the present invention reference should be made to the following detailed description taken in conjunction with the drawing, in which:

FIG. 6 is an enlarged fragmentary elevational view of a lower corner portion of the door of FIG. 1 illustrating details for interconnecting the end of the lower rail to the stile;

FIG. 7 is a transverse, cross-sectional view similar to FIGS. 4 and 5 but illustrating a door having a dual thickness panel of insulating glass and a modified glass stop;

FIG. 8 is a perspective view of a new and improved glass jack constructed in accordance with the features of the present invention;

FIG. 9 is a enlarged perspective view of a circular head disc adapted to be used with the glass jack of FIG. 8 on dual thickness glazing panels as shown in FIG. 7;

FIG. 10 is a top plan view looking downwardly on the assembly of FIG. 9;

FIG. 11 is a cross-sectional view taken substantially along lines 11—11 of FIG. 10;

FIG. 12 is an elevational view of a window construction with glass jacks in accordance with the features of the present invention;

FIG. 13 is a vertical cross-sectional view taken substantially along lines 13—13 of FIG. 12;

FIG. 14 is a vertical cross-sectional view taken substantially along lines 14—14 of FIG. 12;

FIG. 15 is a horizontal, cross-sectional view taken substantially along lines 15—15 of FIG. 12;

DESCRIPTION OF THE PREFERRED EMBODIMENT

Figure 1:
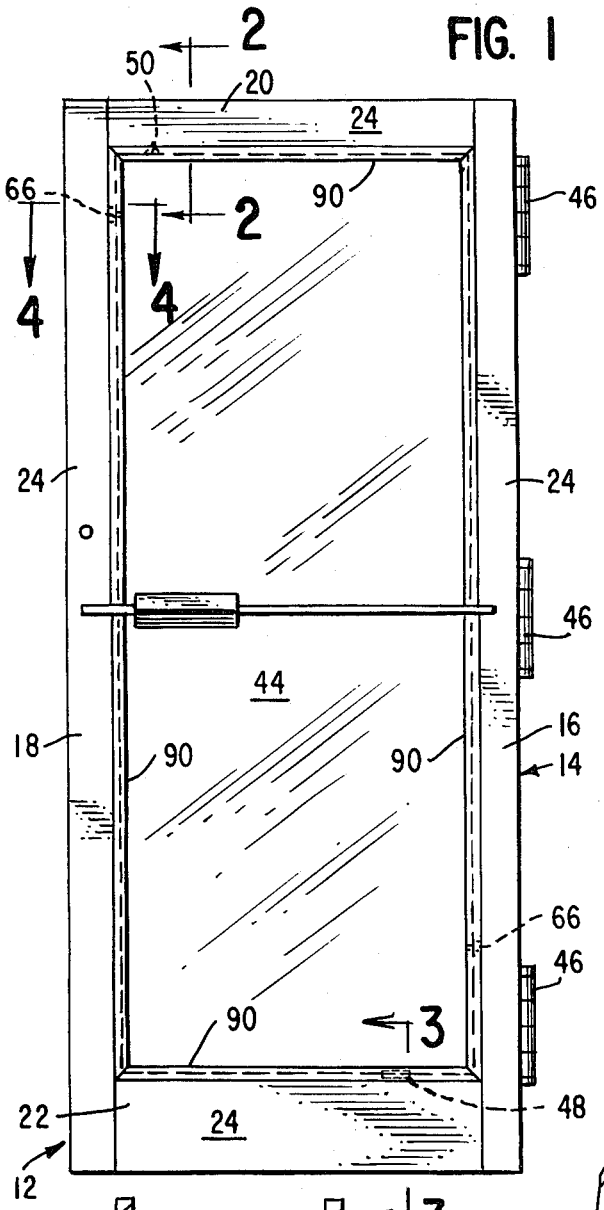
FIG. 1 is an elevational view of a door construction with glass jacks in accordance with the features of the present invention.

Referring now more particularly to the drawings, in FIG. 1 is illustrated a new and improved door construction featuring the present invention and referred to generally by the reference numeral 12. The door is a panel type somewhat similar to the door structure shown in U.S. Pat. Nos. 2,610,369 and 3,780,472 and includes a rectangular metal frame 14 comprising a hinge stile 16, a lock stile, 18 a header rail 20 and a bottom rail 22 interconnected at the corners as shown in greater detail in FIG. 6.

As shown in FIGS. 2, 3, 4, 5, and 7, the stiles and rails of the door construction 12 are of a generally tubular transverse cross section formed of extruded aluminum and each include spaced apart, parallel, inner and outer wall faces 24 and 26, respectively, integrally joined by transversely extending inner and outer walls or webs 28 and 30, respectively.

As illustrated in FIGS. 2, 3, 4, 5, and 7, the inner and outer vertical wall faces 24 and 26 of the respective stiles and rails extend beyond the inside transverse walls 28 to provide retaining ribs 32 which together with the adjacent innerconnecting transverse inside walls 28 form a shallow recess 34 of trapezoidal-shaped transverse cross-section for receiving a pair of stops mounted on opposite sides of the glazing panels as will be described in more detail hereinafter.

As noted in FIG. 6, the opposite ends of the header rail 20 and the bottom rail 22 are adapted to butt fit against the inside surfaces of the vertical hinge and lock stiles 16 and 18, and the rails and stiles are secured together by means of a channel shaped clip 36 having upper and lower flanges **36*a* and 36*b* abutting facing surfaces of the inside and outside transverse walls 28 and 30 and secured thereto by means of weldments 38 formed in drilled openings provided in the walls 28 and 30 closely adjacent the butt-fitted ends thereof. A web 36*c* of the channel shaped clips is positioned to abutt against the face of the adjacent inside wall 28** of the respective stiles.

Fastening bolts 40 are provided to form a strong, secure connection between the respective rails and stiles and the fastening bolts have large headed ends bearing against the webs **36*c* of the channel clips. Threaded shanks of the bolts extend through the webs and the wall 28 of the stiles and are threadedly engaged by nut plates 42 provided in the hollow interior of the tubular vertical stiles 16 and 18**. The corners of the metal door frame are strong, even though the respective stiles and rails may be relatively thin in face width in some models or designs in order to achieve a desired architectural styling.

The inside transverse wall 28 of the respective rails and stiles forms a rectangular shaped glazing opening for receiving a relatively large, thin rectangular-shaped glazing panel 44 preferably of high strength glass suitable for heavy duty applications encountered at most commercial type installations. Glass panels of this type are extremely strong in a vertical direction owing to the relatively large vertical dimension and are similarly strong in a horizontal direction parallel of the opposite faces of the panel. Thus the glass panel itself provides ample strength for resisting door sag or the tendency of the door frame to distort from a rectangular shape into a parallelogram shape wherein the lower end of the lock stile drops below the level of the lower end of the hinge stile which is secured directly to a door jamb by plurality of hinges 46. When a panel door of the character described is designed with relatively narrow width stiles and rails it is desireable to take advantage of the strength available in the glass panel itself rather than to rely wholly on the strength of the metal frame members.

In accordance with the present invention a lower corner of the glazing panel 44 adjacent the hinge stile 16 is supported on a fixed setting block 48 formed of "EPDM" or a similar type of resinous plastic material.

This setting block is positioned approximately 6 inches outwardly of the inside wall 28 of the hinge stile on the lower rail 22. The setting block is generally rectangular in shape and the 6 inch spacing from the wall 28 of the hinge stile 16 approximates a quarter point or $\frac{1}{4}$ of the distance or dimension of the glass panel 44 along the lower edge.

Figure 2:
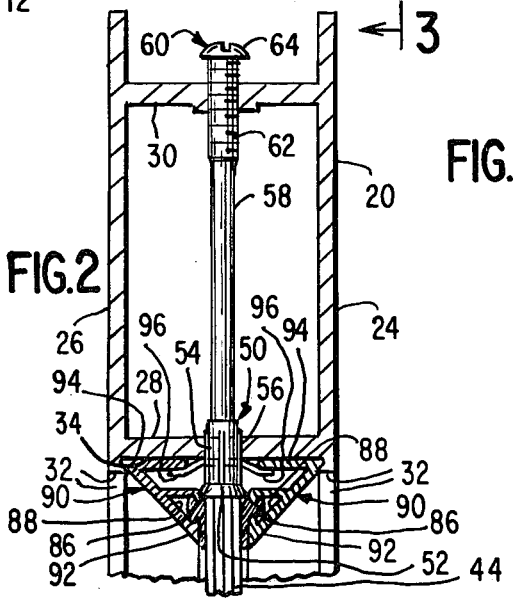
FIG. 2 is an enlarged, fragmentary, vertical, transverse, cross-sectional view of the upper rail of the door taken substantially along lines 2—2 of FIG. 1.

At the upper corner of the panel and spaced inwardly on the header rail 24 approximately 3 inches from the inside wall 28 of the outer lock stile 18 there is provided an adjustable setting block 50 best shown in FIG. 2. This block is preferably formed of molded resinous plastic material such as "Nylon" and includes a bell-shaped lower end portion or anvil 52 adapted to bear downwardly on the upper edge of the glass panel at a location on the door generally diagonally opposite the lower setting block 48. The adjustable, upper setting block includes an upwardly extending cylindrical shank 54 having a plurality of longitudinally extending ribs 56 formed thereon. The shank extends through an aperture provided in the inner transverse wall 28 of the upper rail 20, and the ribs 56 prevent rotation of the setting block during vertical movement toward and away from the upper edge of the glass panel. The upper end of the shank 54 of the setting block is connected to an elongated rod 58 forming an adjustment screw 60 having a threaded shank portion 62 adjacent a rounded head 64 having a slot for a screwdriver. The threaded shank 62 is engaged in a threaded aperture provided in the outer transverse wall 30 of the upper rail 20 so that a screwdriver adjustment of the head 64 will move the adjustable setting block 50 toward or away from the upper edge of the glazing panel 44.

In this manner the spacing distance between the lower surface of the wall 28 of the header rail 20 and the upper edge of the glazing panel 44 is selectively adjusted to a desired clearance. As illustrated in FIG. 2, the inside and outside faces 24 and 26 of the header rail project upwardly beyond the outer transverse wall 30 so that the upper portion of the threaded shank 62 and the head 64 of the adjustment screw 60 is not visible from the front or rear of the door 12. Moreover, ready adjustment of the screw is available by opening the door slightly to expose the head 64 for adjustment.

Should the outer edge of the hinge stile 18 tend to droop downwardly, the head 64 of the adjustment screw may be turned in a clockwise direction to increase the clearance between the upper edge of the glazing panel 44 and the rail 20 adjacent the outer end and thus bring the door frame back into a parallel, rectangular shape.

In accordance with the present invention, the door structure 12 includes a pair of novel glass jacks 66 preferably formed of molded plastic material such as "Nylon" or the like and including elongated shanks 68 having threads thereon for threaded engagement within threaded apertures provided in the inside wall 28 of the respective hinge and lock stiles 16 and 18. The glass jacks include a radial head 70 having alternate ribs and grooves 72 and 74 on the outer edge providing a knurled effect to facilitate manual rotation and adjustment of the glass jacks on the stiles. Initial installation of a glass jack in position on a stile may also be facilitated by means of "Phillips" head type slot 76 formed in the outer end surface so that a screwdriver or power tool can be used to initially mount the glass jacks on a stile.

Figure 4:
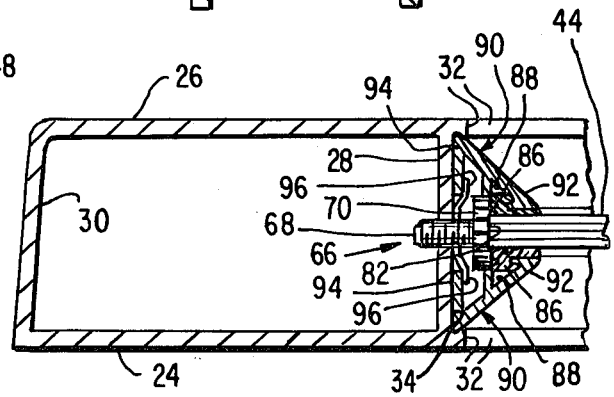
FIG. 4 is a horizontal, transverse, cross-sectional view in enlarged detail taken substantially along lines 4—4 through the lock stile of the door.
Figure 5:
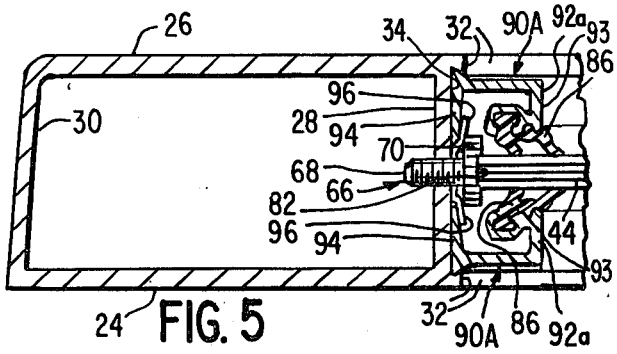
FIG. 5 is a transverse, cross-sectional view similar to FIG. 4 but illustrating a door having a modified form of glass stop installed therein.

In accordance with the present invention, the outer end surface of the head of the glass jacks is provided with an annular ring 80 having a triangular-shaped transverse cross section and an apex formed at the outer edge facing away from the main body and end surface of the head. The sharply pointed outer edge of the annular ring or rib is adapted to move into direct engagement with the adjacent edge of the glazing panel 44 and when finally adjusted, the harder panel edge deforms and depresses diametrically opposed segments 82 of the ring as best shown in FIGS. 4 and 5 to provide stop surfaces in the ring engaging corner edges on opposite faces of the glazing panel. This engagement serves to prevent unwanted rotational movement of the glass jack after a desired setting adjustment is made. The shallow, deformed segments of the annular rib 80 indicated by the reference numerals 82 form stops at each end to provide interferring engagement with the panel edge to preclude inadvertent rotation or working of the glass jack. Intended manual rotation of the glass jack can be readily achieved by direct contact with the alternate ribs 72 and grooves 74 on the outer peripheral edge of the head 70 either with the fingers or with a tool.

The sharply pointed outer apex of the annular rib and the resilient material thereof permits deformation of the rib to provide the stop surfaces at the ends of the depressed segments 82. The jacks are tightened until the edge surface of the glass panel 44 is seated against the flat surface of the main body portion of the head 70. The seating area is represented by a diametrically aligned path shown by the dotted lines 84 in FIG. 8. This contact area is of sufficient size so that material such as "Nylon" is not overstressed and the glass jack is thus capable of transmitting sizeable forces acting in one or both directions between the edge of the glass and the contact area on the head surface of the glass jack.

In addition to a glass jack 66 which is mounted on the lock stile 18 approximately 6 inches below the wall surface 28 of the upper rail 20, a second glass jack 66 is mounted adjacent a lower corner of the door frame between the hinge stile 16 and the panel 44 at a position approximately 6 inches above the inside transverse wall 28 of the lower rail 22. It should be noted that the peripheral edges of the relatively large glass panel 44 are structurally interconnected with the respective stiles and rails of the door frame at only (4) points; namely at the lower setting block 48, the upper adjustable setting element 50 and a pair of glass jacks 66.

Inside and outside faces of the glass panel 44 are sealed around the edges by means of elongated glazing elements 86 formed of flexible resilient plastic material. These glazing elements include outer sealing lips which are compressed against the surfaces of the glass and a body that is keyed into supporting engagement in a longitudinally extending, inside groove 88 formed in bevel type glass stop 90. Elongated glass stops 90 are mounted to extend along the entire periphery of the glazing panel 44 on both the inside and outside faces thereof to cover the space or clearance between the panel edges and the frame members. Each bevel type glass stop 90 includes an inwardly sloping wall portion 92 integrally joined with a base segment 94 along an outer corner, which corner bears against the inside sloping surface of a rib 32 on a stile or rail. The base segment 94 of the stop is snapped into place in the shallow recess 34 of the frame members and is retained after insertion by the edges of clips or spring fingers 96 provided on retainer clips which are mounted at appropriate, longitudinally spaced intervals on the inner walls 28 of the respective stiles and rails. The clips may be of a pie-pan shape secured in place with fasteners such as screws but preferably are of the type shown and described in copending U.S. patent application, Ser. No. 211,512, filed Dec. 1, 1980, which fasteners do not require the use of screws for installation.

Figure 3:
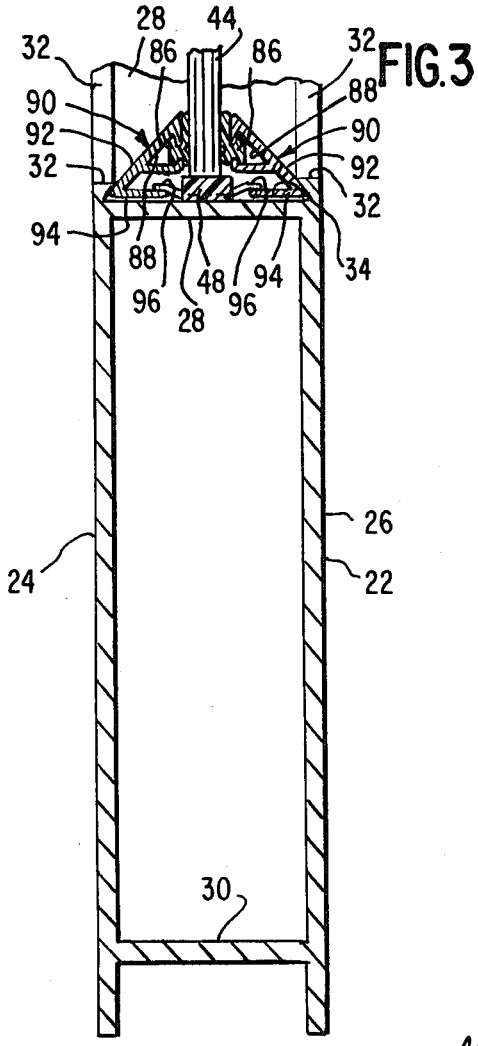
FIG. 3 is an enlarged, vertical, transverse cross-sectional view taken substantially along lines 3—3 of FIG. 1 through the bottom rail of the door.

After the free edge of the base segment 94 of a glazing strip is wedged beneath a spring finger 96 of a retainer clip, the strip is moved forcefully inwardly toward the glass until the corner junction between the sloped wall 92 and the base can be snapped into place inside the wedging surface of the retaining rib 32 on the stile or rail. When the glass stops 90 are snapped into place as shown in FIGS. 2, 3, and 4, the sealing lips of the gaskets or glazing elements 86 are pressed to seal tightly against opposite faces of the glazing panels. When a door 12 is initially glazed or when it is reglazed with the door frame 14 already in a mounted position in a door jamb or opening, one set of glazing stops 90 are installed on an inside or outside face of the door before the glazing panel 44 is lifted into place. After placement of the glazing panel on the setting block 48 and appropriate adjustment of the upper setting block 50 and the pair of glass jacks 66, the outside glazing strips or stops 90 with resilient glazing elements 86 in place thereon are snapped into place to complete the installation and glazing of the panel in the door.

The door construction 12 may thus be easily glazed initially and easily reglazed should glass breakage occur after installation. After completion of the glazing process as described, the panel is firmly connected with the frame at only four main points along the entire edge of the panel and in a unique manner which takes advantage of the great strength of the glass panel itself in a vertical plane. The metal frame 14 supports the glass against wind loads and other loads acting normal thereto as do the stops 90. The ribs 32 of the stiles and rails provide support for the glazing panel against wind loads or other forces acting normal to the face which tend to bend the edges of the panel and which if not otherwise restrained might result in breakage of a pane of glass.

The metal elements and the glass jacks, as well as the glass panel itself all cooperate functionally to form a strong goodlooking door structure 12 which may be easily glazed initially and easily reglazed. The novel structure permits the use of relatively narrow, metal stiles and rails by taking advantage of the inherent strength of the glazing panel in a vertical plane and thus the amount of metal required in stiles and rails may be reduced. The novel glass jacks 66 of the present invention provide an efficient means for adjusting the clearance or spacing between the peripheral edges of the glazing panel and the adjacent walls 28 of the stiles of the door frame. The glass jacks serve to transmit stresses between the glazing panel and the door frame and the deformable annular ribs provide stops for preventing inadvertent rotation of the glass jacks which might result in loosening or permitting the door to become out of adjustment with respect to the clearance or spacing between the edges of the panel and the inside wall 28 of the door frame. Should droop of the door frame occur, the glass jacks may be readjusted to restore parallelism in the door frame. The annular, deformable ribs provide stop surfaces at any and all rotational positions of the jacks relative to the panel edge.

Referring now to specifically to FIG. 5 therein is illustrated a view similar to FIG. 4 wherein channel shaped, modified glass stops 90A are utilized instead of the bevel type stops 90 as previously described, and the operation and the installation of the modified stops is similar. The modified stops include a facia leg **92*a* extending perpendicular to the base section 94 to provide a sidewall parallel of the glazing panel of the door. Each stop also includes an upper flange 93 parallel to the transverse walls 28 of the stiles and rails. Resilient sealing strips 86 similar to those utilized with the beveled glass stops are provided and these strips are interlocked in grooves provided on the flanges to face the adjacent surface of the glazing panel so that lips of the sealing strips 86 will seal tightly against the glass when the stops 90A** are fully installed.

Referring now to FIGS. 7 and 9–11 when a dual thickness glazing panel 44A is to be installed in a door frame, modified forms of glass stops 90B are utilized along with the same type of resilient sealing strips 86. These stops are designed to accommodate the greater thickness of the dual pane glass panel and include a base leg 94 and a facia leg element **92*a* having a groove 95 on the inside surface thereof for supporting a resilient sealing strip 86**.

In order to accommodate the increased thickness of the glazing panel 44A the glass jacks 66 are provided with a larger diameter, head disk 100 also having ribs and grooves 74 and 72 around the circumferential edge thereof to facilitate manual rotation. The disk is snap fitted onto the head 70 of a glass jack 66 and for this purpose includes a coaxially aligned, shallow, cylindrical recess 102 on the underside thereof having a slightly larger diameter than the outside diameter of the head 70. The recess 102 is formed with a shallow annular groove 104 on the inner wall surface, which, as illustrated in FIG. 11 is designed to accommodate the deformable annular rib 80 on the integral head 70 of the glass jack when the larger diameter disk 100 is snapped into place thereon.

A plurality of openings 106 spaced radially outwardly of the central axis are formed to communicate between the upper surface of the disk 100 and the recess 102. The openings 106 are spaced outwardly of the internal groove 104 and immediately below each of the openings there is provided a deflectable wedge element 108. Each wedge element is offset radially with respect to a groove 74 in the edge of the integral head 70 so that when the larger diameter disk 100 is snapped onto the integral head, the wedge element is deflected and wedged between the outer surface of a rib 72 on the head 70 and the inside peripheral wall surface of the circular recess 102 on the underside of the disk 100. The wedging action of each thin element 108 firmly secures the disk 100 on the smaller diameter, intergral head 70 and the modified glass jack is then adpated for use with a dual pane, insulating type glazing panel 44A.

The disk 100 is also preferably made of molded plastic material such as "Nylon" and includes an annular, deformable rib 80 of triangular-shaped, transverse cross section formed on the outer surface for engaging contact against the glass panes of a dual thickness glazing panel 44A. The annular rib 80 has a diameter larger than the thickness of the panel 44A so that once the jack screw is adjusted to provide the desired clearance the edge of the glass and the frame members, depressed segments 82 will be formed in the rib similar to those formed in the rib of the smaller diameter integral head 70 when used with a single thickness panel 44. With the disk 100, a pair of parallel, glass edge bearing areas 84 are disposed on opposite sides of the center of the disk and in line with the depressed segments 82 of the rib 140. The areas 84 indicate a relatively large bearing area on the disk surface that is engaged by the edges of the parallel glass panes after a final adjustment is made.

The deformable rib 80, both on the head 70 and the disk 100 of the glass jack 66 provides an excellent means for restricting inadvertent rotation of the glass jack after the proper clearance is attained. Because the ribs 80 comprise a complete circle, adjusted positions are infinitely continuously rather than incremental intervals. Moreover, the single glass jack 66 is suitable for use with single thickness panels 44 and with insulating glass panels 44A after the disks 100 are installed on the heads 70.

Referring now to FIGS. 12–15, the novel glass jacks 66 with head disks 100 mounted thereon are also useful in supporting and aligning insulating glass panels 44B in a window such as a casement type window 110 having a rectangular frame 112 comprising a hinge stile 114, a lock stile 116, a lower rail 118, and an upper rail 120. The window frame is supported for pivotal movement about a vertical hinge axis A—A on a pair of hinges 122 pivotally interconnecting the window frame 112 to a surrounding frame work in a building wall 124. The building window frame includes a pair of vertical frame members 126, a header 128 and a sill structure 130.

A lower edge of the glazing panel 44B is supported from a web portion **118*a* of the window frame rail 118 on "EPDM" setting block 132 positioned as shown on the lower rail adjacent but spaced from the hinge axis A—A. As shown in FIGS. 12 and 15, a glass jack 66 with a head disk 100 thereon, is mounted on the hinge stile 114 of the window frame a short distance above the lower rail and the shank of the glass jack extends into a web portion 114*a* of the frame member and is threadedly adjustable therein by rotation of the disk 100 prior to installation of glazing stops 90C and wedge gaskets 86**.

Another pair of glass jacks 66 with enlarged heads 100 theron are utilized adjacent the upper, opposite corner of the window frame 112, mounted on the lock stile 116 and on the header rail 120 at the location shown in FIG. 13 to complete the edge mounting of the glazing panel 44B in the window frame.

From the foregoing, it will be seen that a relatively large insulating type glass panel 44B may be adjustably secured in a rectangular window frame 112 by means of a pair of glass jacks 66 on opposite vertical edge surfaces of the glass, a setting block on the bottom rail and a third glass jack on the header rail. Opposite faces of the panel are engaged by wedge gaskets 86 and glazing tapes 133, which tapes bear against the inside surface on the outer face member of the window frame members. The large rectangular glass panel 44B thus provides strength and rigidity in a vertical plane for the window and the peripheral edges of the glass are supported against transverse bending stresses by the metal frame members 114, 116, 118 and 120 which can be light yet still provide an efficient window unit.

As illustrated, the respective inside and outside metal members of the window sash frame members and the surrounding building wall frame are insulated from one another with continuous resinous plastic, heat insulating elements 134 which provide a thermal break in the path of heat conduction between the inner and outer metal elements. In addition, insulating sealing gaskets 136 are provided around the complete periphery of the window adjacent both the inside and the outside faces to reduce or eliminate altogether any air and water infiltration and thereby provide a more efficient and heat effective window unit.

Figure 16:
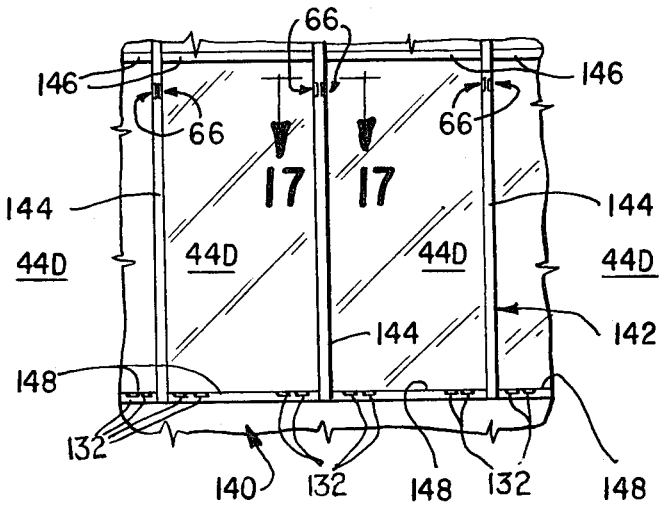
FIG. 16 is an elevational view of a curtain wall construction with glass jacks in accordance with the features of the present invention.
Figure 17:
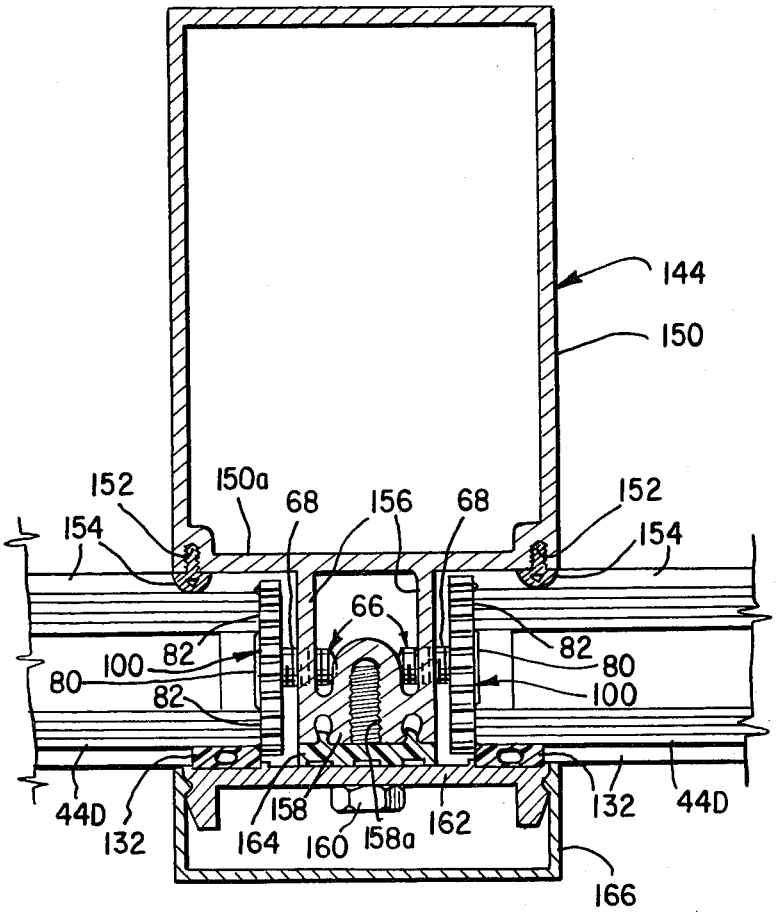
FIG. 17 is a horizontal, cross-sectional view taken substantially along lines 17—17 of FIG. 16.

Referring now to FIGS. 16 and 17, therein is illustrated a new and improved curtain wall structure 140 for a building which includes a plurality of relatively large, heat insulating type glazing panels 44D. The panels are supported in rectangular openings provided by a frame work 142 formed with vertical mullion assemblies 144, horizontally extending upper header assemblies 146 and horizontal lower sill assemblies 148.

In accordance with the present invention, each glazing panel 44D is supported at the quarter points on the bottom edge from a sill member 148 with a pair of "EPDM" setting blocks. In addition to the setting blocks on the sill, there are provided headed glazing jacks 66 mounted on the mullion elements 144 to engage the opposite edge of each panel adjacent the upper end portion of the panels for positioning and securely holding the panels in the curtain wall frame work.

Referring to FIG. 17, the mullion assembly 144 includes an inside metal element 150 of hollow, generally rectangular, tubular transverse cross-section and formed with a pair of grooves 152 along the edges of an outwardly facing wall portion **150*a*. Inside sealing gaskets 154 are mounted in the grooves to bear against the inside faces of the glazing panels 44D** around the periphery thereof.

The mullion element 150 includes a pair of outwardly extending flanges 156 integrally joined with the wall **150*a* and the shanks 68 of the glass jacks 66 are threadedly engaged in apertures provided in the flanges to permit lateral adjustment of the spacing between the edges of the panels 44D and the flanges upon rotation of the head disks 100. The flanges 156, are joined at the outer end with an integral web portion 158 having a centrally disposed, outwardly opening, longitudinal slot 158*a* for receiving threaded shanks of cap screws 160 which are utilized to secure a channel-shaped outer glazing stop 162 in place for retaining the glazing panels 44D in the wall structure. Resinous plastic heat insulating spacer blocks 164 are mounted at appropriate intervals along the outer face of the web portion 158 of the mullion element to form a thermal barrier or heat insulating break between the inside metal portion and the outside, channel-shaped glass stop 162**.

Glazing tapes 133 are provided between the outer face of the panels 44D along the vertical edges and the adjacent inside face surface of the glazing stop in order to positively secure the panels in place as illustrated. A snap-on type, outer, mullion face cover 166 of channel-shaped cross-section is then mounted on the glass stop 162 and snapped into place after the cap screws have been installed.

From the foregoing, it will be seen that the novel glass jacks 66 and head disks 100 in accordance with the invention provide an efficient and convenient means for adjusting and securely maintaining the position of large glazing panels within support frames of door structures, window structures and fixed walls such as curtain walls and the like. The glass jack of the present invention is universally adaptable for a wide variety of applications and after it is adjusted to the provide the proper spacing, the jack firmly retains the adjusted position because of the novel, annular deformable rib, on the head surface of the jack.

While there have been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A door construction comprising:

a rectangular frame having interconnected stiles and rails providing one or more rectangular openings for receiving panels;

a panel mounted in said opening having outer peripheral edges closely facing adjacent surfaces of said frame; and one or more jacks extending between an edge of said panel and an adjacent facing surface of said frame for maintaining adjustable selected spacing between said edge and said adjacent facing frame surface, said jack including an elongated threaded shank adapted to be mounted in threaded engagement in an opening formed in said adjacent facing frame surface for movement normal thereto upon rotation of said shank to provide adjustment of said spacing and a head extending radially outward of said shank having an end surface adapted to engage said edge of said panel, said head having a peripheral edge surface with ribs and grooves thereon to facilitate manual rotation thereof for adjusting said spacing and annular rib means on said end surface of said head having a diameter greater than thickness of said panel and deformable in portions engaged against said edge of said panel thereby forming stops engaging corners on opposite faces of said panel adjacent said edge for resisting inadvertent rotation of said jack after said selected spacing is attained.

2. The door construction of claim 1 wherein said jack is formed of resilient plastic material and said rib means is integrally formed in concentric alignment around a longitudinal axis of said shank.

3. The door construction of claim 1 or 2 wherein said rib means has a radial transverse cross-section tapering to a minimum width away from said end surface.

4. The door construction of claim 3 wherein said rib means is substantially triangular-shaped in radial transverse cross-section with a base adjacent said end surface and an apex forming said minimum width spaced away from said end surface.

5. The door construction of claim 1 or 2 wherein said rib means has a diameter substantially greater than the thickness of said panel and extends outwardly of opposite faces of said panel.

6. The door construction of claim 1 wherein said frame includes a hinge stile, a lock stile, an upper rail and a lower rail forming said rectangular opening and said panel includes a pair of vertical side edges and a pair of horizontal edges closely facing said respective stiles and rails, said panel including opposite faces spaced inwardly from respective wall faces of said stiles and rails;

a setting block between a lower edge of said panel and said lower rail spaced outwardly of said hinge stile;

an adjustable upper setting block between an upper edge of said panel and said upper rail spaced inwardly of said lock stile; and a pair of said glass jacks, a first jack between an edge of said panel and said hinge stile spaced upwardly of said lower rail, and a second jack between an edge of said panel and said lock stile spaced downwardly of said upper rail.

7. The door construction of claim 6 wherein said setting block is spaced approximately 6" from said hinge stile and said upper adjustable setting block is spaced approximately 3" from said lock stile.

8. The door construction of claim 6 or 7 wherein said first jack is spaced approximately 6" above said lower rail and said second jack is spaced about 6" below said upper rail.

9. The door construction of claim 1 wherein said panel has opposite faces spaced inwardly of opposite wall faces of said rectangular frame, said glass jacks having heads with an outer diameter greater than the thickness between opposite faces of said panel but less then the spacing between said opposite wall faces of said rectangular frame.

10. The door construction of claim 9 including a plurality of elongated panel stops on opposite faces around the periphery of said panel engaging respective stiles and rails of said rectangular frame and covering portions of the heads of said glass jacks that extend outwardly of opposite faces of said panel.

11. A glass jack for maintaining a selectively adjusted spacing between the edge of a panel and the wall of an adjacent frame member said jack comprising:

an elongated threaded shank adapted to be mounted in threaded engagement in an opening formed in said wall for movement normal thereto upon rotation of said shank to provide adjustment of said spacing, and a head extending radially outward of said shank having an end surface adapted to engage said edge of said panel, said head having a peripheral edge surface with ribs and grooves thereon to facilitate manual rotation thereof for adjusting said spacing, and annular rib means on said end surface of said head having a diameter greater than the thickness of said panel and deformable in portions engaged against said edge of said panel thereby forming stops for engaging corners on opposite faces of said panel at said edge for resisting inadvertent rotation of said jack after said selected spacing is attained.

12. The glass jack of claim 11 wherein said end surface of said head is substantially planar and said rib means projects outwardly thereof and is concentric of a longitudinal axis of said shank.

13. The glass jack of claim 11 or 12 formed of integrally molded resinous plastic material.

14. The glass jack of claim 12 wherein said rib means is formed with a substantially triangular-shaped transverse radial cross-section tapering to an apex spaced from said substantially planar end surface.

15. The glass jack of claim 2 wherein said rib means is spaced inwardly of said ribs and grooves of said peripheral edge surface.

16. The glass jack of claim 11 or 12 in combination with a disk adapted to securely fit onto said head and having an outer diameter greater than said head for engagement with the edges of dual pane glazing panels, said disk having a substantially planar outer end surface and a generally circular peripheral edge formed with alternate ribs and grooves spaced concentrically outward of said ribs and grooves of said head and having portions extending outwardly of opposite faces of said dual pane glazing panels.

17. The glass jack of claim 16 wherein said end surface of said disk is formed with annular rib means projecting outwardly thereof and deformable upon engagement with edges of said dual pane glazing panel to form stops for preventing inadvertent rotation of said glass jack.

18. The glass jack of claim 16 wherein said disk is formed with a concentric circular recess therein on a side opposite said outer end surface, said disk being adapted to receive said head of said jack when snap fitted thereon.

19. The glass jack of claim 18 wherein sad disk is provided with a plurality of thin radially extending deformable wedge elements spaced around the circumference of said circular recess and adapted to be wedged into said grooves on the peripheral edge of said head to secure said disk in place thereon.

20. The glass jack of claim 19 wherein said wedge elements are deflectable to wedge between adjacent surfaces of said recess of said disk and said ribs of said head for securing said disk in place on said head.

21. A window comprising:

a rectangular frame having interconnected stiles and rails providing one or more rectangular openings for receiving panels;

a panel mounted in said opening having outer peripheral edges closely facing adjacent surfaces of said frame; and a glass jack extending between an edge of said panel and an adjacent facing surface of said frame for maintaining adjustable selected spacing between said edge and said adjacent facing frame surface, said jack including an elongated threaded shank adapted to be mounted in threaded engagement in an opening formed in said adjacent facing frame surface for movement normal thereto upon rotation of said shank to provide adjustment of said spacing and including a head extending radially outward of said shank having an end surface adapted to engage said edge of said panel, said head having a peripheral edge surface with ribs and grooves thereon to facilitate manual rotation thereof for adjusting said spacing and annular rib means on said end surface of said head having a diameter greater than the thickness of said panel and deformable in portions engaged against said edge of said panel thereby forming stops engaging corners on opposite faces of said panel adjacent said edge for resisting inadvertent rotation of said jack after said selected spacing is attained.

22. The window of claim 21 wherein said jack is formed of resilient plastic material and said rib means is integrally formed in concentric alignment around a longitudinal axis of said shank.

23. The window of claim 21 wherein said rib means has a radial transverse cross-section tapering to a minimum width away from said end surface.

24. The window of claim 23 wherein said rib means is substantially triangular-shaped in radial transverse cross-section with a base adjacent said end surface and an apex forming said minimum width spaced away from said end surface.

25. The window of claim 21 wherein said rib means has a diameter substantially greater than the thickness of said panel and extends outwardly of opposite faces of said panel.

26. The window of claim 21 wherein said frame includes a hinge stile, a lock stile, an upper rail and a lower rail forming said rectangular opening and said panel includes a pair of vertical side edges and a pair of horizontal edges closely facing said respective stiles and rails, said panel including opposite faces spaced inwardly from respective wall faces of said stiles and rails;

a setting block between a lower edge of said panel and said lower rail spaced outwardly of said hinge stile; and a second one of said glass jacks between an upper edge of said panel and said upper rail spaced inwardly of said lock stile.

27. The window of claim 26 including:

a third one said glass jacks, between an edge of said panel and said hinge stile spaced upwardly of said lower rail.

28. The window of claim 27 wherein said jack is positioned between an edge of said panel and said lock stile spaced downwardly of said upper rail.

29. A curtain wall contruction comprising:

a rectangular frame having interconnected vertical mullions and horizontal members including a sill and a header forming one or more rectangular openings for receiving panels;

a panel mounted in said opening having outer peripheral edges closely facing adjacent surfaces of said mullion and a lower edge adjacent said sill;

a pair of setting blocks on said sill at quarter points along the bottom edges of said panel extending between the lower edge of said panel and the adjacent facing surface of said sill for maintaining and supporting said panel with an adjustable selected spacing distance between said lower edge and said sill, a glass jack between each vertical edge of said panel adjacent an upper end thereof and the adjacent mullion for maintaining adjustable selected spacing between the vertical edges of said panel and said mullions, and said jacks including an elongated threaded shank adapted to be mounted in threaded engagement in an opening formed in said adjacent facing frame surface for movement normal thereto upon rotation of said shank to provide adjustment of said spacing and including a head extending radially outward of said shank having an end surface adapted to engage said edge of said panel, said head having a peripheral edge surface with ribs and grooves thereon to facilitate manual rotation thereof for adjusting said spacing; and annular rib means on said end surface of said head having a diameter greater than the thickness of said panel and deformable in portions engaged against said edge of said panel thereby forming stops engaging corners on opposite faces of said panel adjacent said edge for resisting inadvertent rotation of said jack after said selected spacing is attained.

30. The curtain wall of claim 29 wherein said jacks are formed of resilient plastic material and said rib means is integrally formed in concentric alignment around a longitudinal axis of said shank.

31. The curtain wall of claim 29 wherein said rib means has a radial transverse cross-section tapering to a minimum width away from said end surface.

32. The curtain wall of claim 31 wherein said rib means is substantially triangular-shaped in radial transverse cross-section with a base adjacent said end surface and an apex forming said minimum width spaced away from said end surface.

33. The curtain wall struction of claim 29 wherein said rib means has a diameter substantially greater than the thickness of said panel and extends outwardly of opposite faces of said panel.

* * * * *